US005629666A

United States Patent [19]

Imai et al.

[11] Patent Number: 5,629,666

[45] Date of Patent: May 13, 1997

[54] POWER RESISTOR, METHOD OF MANUFACTURING THE SAME, AND POWER CIRCUIT BREAKER

[75] Inventors: Motomasa Imai, Tokyo; Naoki Shutoh; Fumio Ueno, both of Yokohama, all of Japan

[73] Assignee: Kabushiki Kaisha Toshiba, Kawasaki, Japan

[21] Appl. No.: 445,725

[22] Filed: May 22, 1995

[30] Foreign Application Priority Data

May 23, 1994 [JP] Japan ..... 6-108617

[51] Int. Cl.[6] ..... H01C 7/10

[52] U.S. Cl. ..... 338/20; 338/21; 338/22 SD; 252/508

[58] Field of Search ..... 338/22 SD, 20, 338/21, 225, 224, 223, 308; 252/508; 501/100; 218/143

[56] References Cited

U.S. PATENT DOCUMENTS

| | | | |
|---|---|---|---|
| 1,509,493 | 2/1922 | Slepian | 252/508 |
| 2,901,442 | 2/1958 | Huffadine et al. | 252/508 |
| 3,682,839 | 8/1972 | Galloway . | |
| 3,953,371 | 4/1976 | May | 252/512 |
| 4,418,327 | 11/1983 | Pallila et al. | 338/223 |
| 4,700,169 | 10/1987 | Tanno | 38/308 |
| 4,877,554 | 10/1989 | Homna et al. . | |
| 4,943,795 | 7/1990 | Yamazaki et al. | 338/21 |
| 5,069,854 | 12/1992 | Kitao et al. | 252/508 |
| 5,182,540 | 1/1993 | Shuto et al. | 338/223 |
| 5,509,558 | 4/1996 | Imai et al. | 338/20 |

FOREIGN PATENT DOCUMENTS

| | | |
|---|---|---|
| 64-14166 | 1/1989 | Japan . |
| 4-247601 | 9/1992 | Japan . |

*Primary Examiner*—Teresa J. Walberg
*Assistant Examiner*—Karl Easthom
*Attorney, Agent, or Firm*—Oblon, Spivak, McClelland, Maier & Neustadt, P.C.

[57] ABSTRACT

Disclosed is a power resistor which has a large heat capacity per unit volume and an appropriate and stable electrical resistance, and in which the resistance changes little with time due to surge absorption. This power resistor includes a sintered body containing aluminum oxide and carbon, and a pair of electrodes formed on the two opposing surfaces of the sintered body. This sintered body consists of first regions containing a small amount of carbon or not containing carbon and second regions containing a larger amount of carbon than in the first regions and so arranged as to be connected to the electrodes.

9 Claims, 3 Drawing Sheets

POWER RESISTOR, METHOD OF MANUFACTURING THE SAME, AND POWER CIRCUIT BREAKER

BACKGROUND OF THE INVENTION

1. Field of the Invention

The present invention relates to a power resistor suitable as a fixed resistor, a variable resistor, or a resistor array for use in a high-voltage apparatus or in a charger/discharger for a capacitor with a large capacitance, a method of manufacturing this power resistor, and a power circuit breaker including this power resistor as a closing resistor.

2. Description of the Related Art

Generally, the materials of a power resistor are roughly classified into metal resistor materials, metal oxide resistor materials, and nonmetal resistor materials. Of these materials, the metal oxide resistor materials have a high heat resistance, good withstand voltage current properties, and a high energy resistance with which a high electric energy is absorbed, in comparison with those of the other resistor materials.

Representative metal oxide resistors are disclosed in Jpn. Pat. Appln. KOKAI Publication Nos. 58-139401 and 59-217668.

Jpn. Pat. Appln. KOKAI Publication No. 58-139401 has disclosed a carbon particle dispersed ceramic resistor manufactured by dispersing a conductive carbon powder in an insulating aluminum oxide crystal and sintering the resultant material with clay.

Jpn. Pat. Appln. KOKAI Publication No. 59-217668 has disclosed a carbon-based power resistor which uses, as the raw material, a material formed by adding a carbon powder and a binder to a powder of an insulating inorganic material, such as aluminum oxide, mullite, or calcined clay, and mixing, kneading, and heating the resultant material. Jpn. Pat. Appln. KOKAI Publication No. 59-217668 describes that the carbon powder is a fine powder with a particle size of 0.1 μm or smaller and 1.5 to 5 wt. % of this fine powder are contained.

In the manufacture of a sintered body formed by the addition of a carbon powder to an aluminum oxide powder, the sintering properties of the aluminum oxide are usually impaired. To prevent this, in the manufacture of the carbon particle dispersed ceramic resistor described above the common approach is to add a carbon powder to an aluminum oxide powder and further add clay before sintering in order to make up for the sintering properties of the aluminum oxide. Unfortunately, the addition of clay cannot improve the sintering properties; it merely binds the aluminum oxide power with the carbon powder. The porosity of the resultant resistor, therefore, is as high as 10 to 30%, i.e., the denseness of the resistor is low. As a consequence, the carbon particle dispersed ceramic resistor thus manufactured brings about the following problems.

That is, when this resistor is used as a closing resistor of a breaker which is connected in parallel with a breaking contact for the purpose of absorbing surge occurring upon switching or increasing the breaking capacity, the heat capacity per volume becomes as small as 2 $J/cm^3 \cdot K$ due to the decrease in the denseness of the resistor mentioned above. Consequently, the temperature of the resistor rises significantly with energy absorption such as surge. Additionally, upon current supply the carbon powder discharges in pores to cause feedthrough discharge. Therefore, a breaker incorporating the carbon particle dispersed ceramic resistor described above is increased in size in order to keep the space for storing the resistor. It is also necessary to keep the breaking capacity low in order to ensure reliability.

Furthermore, since a carbon powder is difficult to uniformly disperse, it is difficult to manufacture a carbon particle dispersed ceramic resistor having the intended resistance with a high reproducibility. Moreover, the resistivity has a distribution in the interior of the sintered body. This brings about a temperature distribution when the temperature of the resistor rises with energy absorption such as surge, with the result that the resistor is broken by the thermal expansion difference. The resistor is also unsatisfactory in strength due to its high porosity.

A power resistor manufacturing method described below is known as the method by which the above conventional problems are solved. That is, this power resistor manufacturing method comprises the steps of: preparing a powder mixture by adding, to a metal oxide powder, a carbon precursor made from an organic compound such as a resol-based phenolic resin and a solvent, and mixing and drying the resultant material; forming a powder compact by molding the powder mixture; and thermally sintering the powder compact in a vacuum or in a non-oxidizing gas at a temperature of 1300° to 1800° C., thereby manufacturing a sintered body containing the metal oxide as a main constituent and 0.005 to 3 wt. % of carbon with a mean particle size of 1 μm or smaller as a sub constituent.

In the above method, the metal oxide powder and the carbon precursor are together dispersed in a liquid phase, mixed, molded, and sintered with heat, and thereby the carbon precursor is converted into carbon by a vapor-phase process. Consequently, it is possible to manufacture a sintered body in which ultrafine carbon is dispersed in the grain boundaries of the metal oxide. Also, in the sintering of the molded product the carbon powder which impairs the sintering properties of the metal oxide powder does not exist. This improves the sintering properties of the metal oxide powder to make it possible to obtain a sintered body with a high denseness. Consequently, a power resistor with a high specific heat per unit volume can be manufactured.

Unfortunately, in manufacturing a sintered body with a high resistivity exceeding $10^3$ Ω·cm by this method, variations in the manufacturing conditions are significantly reflected since the number of carbon connections for imparting conductivity is small. Consequently, it is not necessarily easy to obtain a sintered body having the intended resistivity with a high reproducibility.

SUMMARY OF THE INVENTION

It is an object of the present invention to provide a power resistor which has a large heat capacity per unit volume and an appropriate and stable electrical resistance, and in which the resistance changes little with time due to surge absorption.

It is another object of the present invention to provide a method of manufacturing a power resistor which has a large heat capacity per unit volume and an appropriate and stable electrical resistance, and in which the resistance changes little with time due to surge absorption.

It is still another object of the present invention to provide a power circuit breaker which includes a closing resistor with a large breaking capacity and a stable breaking performance and which thereby achieves a small size and a high performance.

According to the first aspect of the present invention, there is provided a power resistor comprising:

a sintered body containing aluminum oxide and carbon; and a pair of electrodes formed on two opposing surfaces of the sintered body, wherein the sintered body consists of a first region containing a small amount of carbon or not containing carbon and a second region containing a larger amount of carbon than in the first region and so arranged as to be connected to the electrodes.

According to the second aspect of the present invention, there is provided a method of manufacturing a power resistor, comprising steps of:

preparing a first granurated material for forming a first region which contains a smaller amount of carbon or does not contain carbon by dissolving an organic compound as a carbon precursor in a solvent, dispersing the solution into an aluminum oxide powder, removing the solvent from the dispersion, and granurating the resultant material;

preparing a second granurated material for forming a second region which contains a larger amount of carbon than in the first region by dissolving an organic compound as a carbon precursor in a solvent, dispersing the solution into an aluminum oxide powder, removing the solvent from the dispersion, and granurating the resultant material;

forming a sintered body by mixing the first and second granurated materials, and molding and sintering the resultant mixture; and forming a pair of electrodes on opposing major surfaces of the sintered body.

According to the third aspect of the present invention, there is provided a method of manufacturing a power resistor, comprising steps of:

preparing a first granurated material for forming a first region which contains a smaller amount of carbon powder or does not contain carbon powder and contains an aluminum oxide powder;

preparing a second granurated material for forming a second region which contains a larger amount of carbon powder than in the first region and contains an aluminum oxide powder;

forming a sintered body by mixing the first and second granurated material, and molding and sintering the resultant mixture; and forming a pair of electrodes on opposing major surfaces of the sintered body.

According to the fourth aspect of the present invention, there is provided a power circuit breaker comprising:

main switching means arranged on a current path;

auxiliary switching means connected to the current path parallely with respect to the main switching and turned on before the main switching means is turned on; and a closing resistor unit connected in series with the auxiliary switching means and incorporating a resistor having a sintered body and electrodes formed on opposing surfaces of the sintered body, the sintered body consisting of a first region containing a small amount of carbon or not containing carbon and a second region containing a larger amount of carbon than in the first region and so arranged as to be connected to the electrodes.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 2:
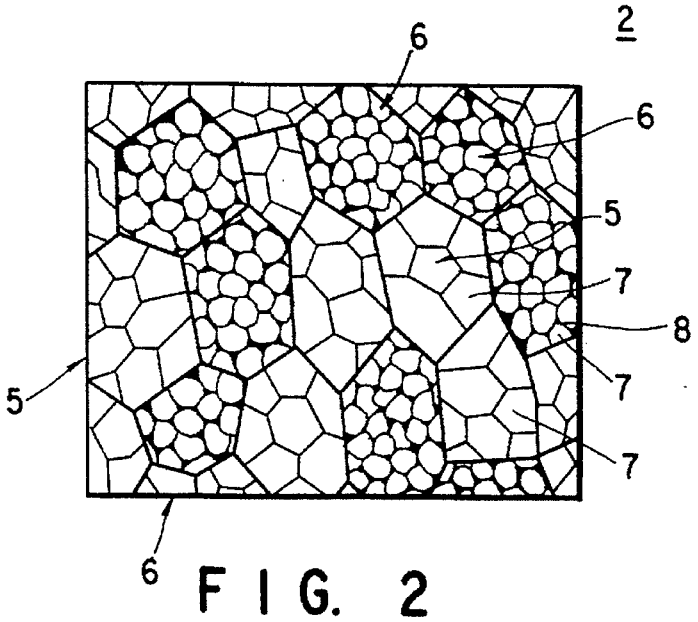
FIG. 2 is a view schematically showing the minute structure of a sintered body in the resistor in FIG. 1.
Figure 3:
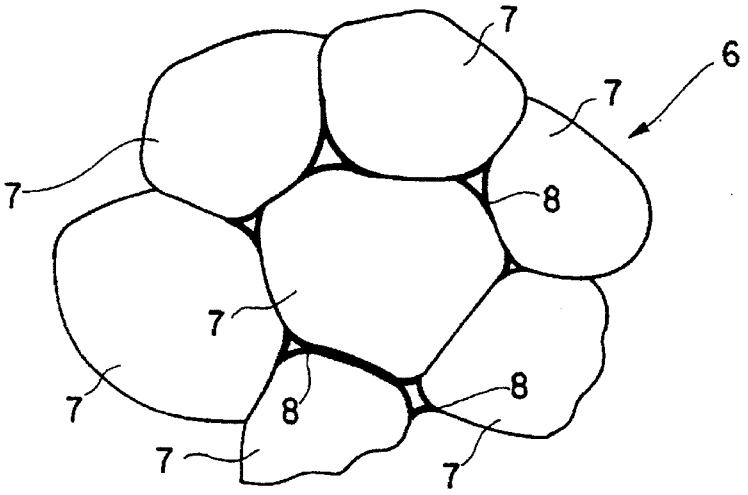
FIG. 3 is a view schematically showing a second region, FIG. 2, in an enlarged scale.

A power resistor according to the present invention will be described in detail below with reference to FIGS. 1 to 3.

Figure 1:
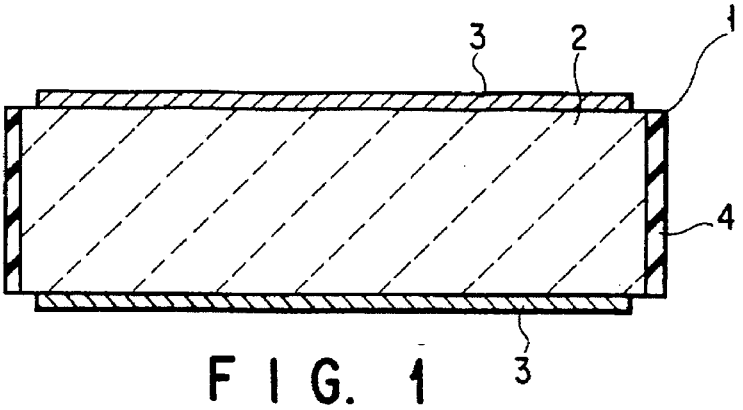
FIG. 1 is a sectional view showing a power resistor according to the present invention.

FIG. 1 is a sectional view showing the power resistor according to the present invention. FIG. 2 is a schematic view showing the minute structure of a sintered body in FIG. 1. FIG. 3 is an enlarged schematic view showing a second region in FIG. 2. A resistor 1 consists of a disk-like sintered body 2, a pair of electrodes 3 formed on the two circular surfaces of the sintered body 2, and an insulating layer 4 coated on the outer circumferential surface of the sintered body 2. The sintered body 2 has a composition which contains aluminum oxide and carbon produced by carbonizing an organic compound. As in FIG. 2, this sintered body 2 has first regions 5 containing a small amount of carbon or not containing carbon, and second regions 6 containing a larger amount of carbon than in the first regions 5. The first regions 5 are essentially insulating, and the second regions 6 are conductive. In the sintered body 2, the second regions 6 are connected together by a three-dimensional network structure and so arranged as to be connected to the electrodes 3. The resistance of the sintered body 2 is controlled by this connected state of the second regions 6 and by the resistivity of the second regions 6 themselves. As illustrated in FIG. 3, in each second region 6, conductive carbon 8 mainly exists at the triple points of the grain boundary of aluminum oxide particles 7. The second regions 6 are electrically connected together by this carbon 8.

It is preferable that the first regions 5 occupy a greater part of the sintered body 2 and the second regions 6 occupy the remaining part of the body 2, and that the carbon present in the second regions 6 electrically connect the pair of electrodes 3. It is particularly desirable that the first regions 5 occupy 50 to 80 wt. % of the sintered body 2 and the second regions 6 occupy 20 to 50 wt. % thereof. If the sintered body 2 consists of the first regions 5 and the second regions 6 in this weight percentage, it is desirable that the carbon accounts for 0.005 to 3 wt. %, with the first regions 5 containing less than 0.2 wt. % (including 0 wt. %) of carbon and the second regions 6 containing 0.2 to 5 wt. % of carbon. The reason for this specific carbon content is as follows.

If the carbon amount in the sintered body is smaller than 0.005 wt. %, carbon does not exhibit its conductivity well. As a result, the resistivity of the sintered body becomes $10^5$ Ω·cm or higher, which is too high as the resistivity of a power resistor. On the other hand, a carbon amount larger than 3 wt. % results in a low electrical resistance of 10 Ω·cm or lower, so this carbon amount also is inadequate for a power resistor. The carbon amount in the sintered body 2 is more preferably 0.1 to 1.5 wt. %.

If the carbon content in the first regions 5 is more than 0.2 wt. %, the first region does not have insulating properties.

The resistivity of the second regions 6 is controlled by the carbon content. If the carbon content in the second regions 6 is smaller than 0.2 wt. %, the resulting resistivity is $10^5$ Ω·cm or higher, which is too high as the resistivity of a power resistor. If, on the other hand, the carbon content in the second regions 6 exceeds 5 wt. %, it becomes difficult to obtain the effect of the present invention that is attained by constituting the sintered body with the first and second regions. The carbon content in the second region is more preferably 0.5 to 3 wt. %.

If the first regions 5 contain relatively much carbon in an amount less than 0.2 wt. %, the electrodes 3 are electrically connected not only by the carbon contained in the second regions 6, but also by the carbon contained in the first regions 5.

The particle size of the aluminum oxide particles in the second regions is preferably smaller than that of the aluminum oxide particles in the first regions 5. More specifically, it is desirable that the aluminum oxide particles in the second regions 6 have a mean particle size of 0.2 to 0.5 μm, and the aluminum oxide particles in the first regions 5 have a particle size 2 to 8 times, more preferably 3 to 6 times as large as the particle size of the aluminum oxide particles in the second regions. A power resistor including the sintered body 2 consisting of the first and second regions 5 and 6 containing aluminum oxide particles of different particle sizes is improved in the switching surge absorption.

The sintered body described above preferably has a high-resistance layer, which has a particle size larger than that of the aluminum oxide particles in the interior of the sintered body and also has a high resistance, on the outer surface excluding the electrodes. This high-resistance layer preferably has a thickness of 50 to 1000 μm. The mean particle size of the aluminum oxide particles constituting the high-resistance layer is preferably 1.2 to 2 times as large as the mean particle size of the aluminum oxide particles in the first regions 5 in the interior of the sintered body. A power resistor including the sintered body having this high-resistance layer on the outer surface is improved in the insulating properties and the injection energy resistance. Therefore, the power resistor can be used at high temperatures with high voltages and large injection energy.

The sintered body 2 may contain an impurity such as aluminum oxynitride or aluminum oxycarbide, provided the amount of the impurity is not so large as to affect the thermal capacity of the body 2.

The electrodes 3 are preferably constructed from a metal such as aluminum or nickel, a carbide of Hf, Nb, Ta, or Ti, or TiN.

The insulating layer 4 is formed on the circumferential surface of the sintered body 2 in order to prevent creeping discharge on that surface. The insulating layer 4 is preferably made from ceramic such as aluminum oxide, silicon oxide, or borosilicate glass, or from an insulating heat-resistant resin such as a polyimide.

In the power resistor according to the present invention described above, the sintered body 2 consists of the first regions 5 containing a small amount of carbon or not containing carbon and the second regions 6 containing a larger amount of carbon than in the first regions 5. The first regions 5 are essentially insulating, and the second regions 6 are conductive. The second regions 6 are connected together by a three-dimensional network structure and so arranged as to be connected to the electrodes 3. Since this sintered body has a high denseness, a resistor including the sintered body has a high strength and is also improved in the heat capacity per unit volume.

As described above, the second regions 6 are connected together by a three-dimensional network structure and so arranged as to be connected to the electrodes 3. Consequently, it is possible to realize a power resistor including a sintered body having an appropriate and stable electrical resistance.

Additionally, the resistance of the sintered body 2 can be controlled by the connected state of the second regions 6 and the resistivity of the second regions 6 themselves. That is, while keeping a sufficient number of connections between the second regions 6, it is possible to properly increase the resistivity of, i.e., decrease the carbon content of the second regions 6 which exhibit conductivity. This makes it possible to obtain a sintered body with a relatively high and stable resistivity.

Furthermore, the sintered body has the second regions 6 which are connected together by a three-dimensional network structure and so arranged as to be connected to the electrodes 3. Accordingly, a resistor including this sintered body can maintain its resistivity stable against energy absorption such as surge. This results in a small change in the resistance with time.

In particular, a power resistor including a sintered body which has a total carbon amount of 0.005 to 3 wt. % and consists of first regions whose carbon amount is less than 0.2 wt. % (including 0 wt. %) and second regions whose carbon amount is 0.2 to 5 wt. % notably exhibits the above characteristics; that is, in this resistor the heat capacity per unit volume is large, the electrical resistance is proper and stable, the resistivity is kept stable against energy absorption such as surge, and the resistance changes little with time.

A method of manufacturing a power resistor with the structure shown in FIGS. 1 to 3 described above will be described in detail below.

First, an aluminum oxide powder with a mean particle size of 1 μm or smaller, preferably 0.5 μm or smaller with which good sintering properties are obtained is milled together with a desired solvent by a ball mill. An organic compound as a carbon precursor is dissolved in water or an organic solvent, and the resultant solution is added to the milled powder of the aluminum oxide and mixed in the ball mill. The organic compound is preferably a substance which readily leaves behind carbon upon being heated in a non-oxidizing gas. Examples are a resol-based phenolic resin, an acrylic resin, a polyvinyl chloride resin, cellulose, and polyvinylpyrrolidone. It is possible to use these organic compounds either singly or in the form of a mixture of two or more types of them. In this step, in order to prepare a first granulated material for forming first regions containing a small amount of carbon or not containing carbon, a mixture (first mixture) which contains a small amount of the organic compound or has a composition with which carbon is not left behind in a sintering step (to be described later) is formed. Also, a mixture (second mixture) which contains a large amount of the organic compound is formed to prepare a second granulated material for forming second regions. Note that these first and second mixtures can be added with a molding binder, such as paraffin or polyvinyl alcohol, where necessary. Note also that if this binder is to be used as a carbon source of a sintered body, it is preferable to adjust the amount of the organic compound by taking into account the addition amount of the binder.

Subsequently, the solvents are removed from the first and second mixtures by using, e.g., a spray dryer, and the resultant first and second mixtures are granulated to prepare the first and second granulated materials, respectively. The first and second granulated materials are then mixed at a predetermined ratio by, e.g., a V mixer and molded into a molded product. As the molding means it is possible to use, e.g., mold pressing, an extrusion process, or injection molding. When mold pressing is to be used, the process is preferably performed at a pressure of 200 kg/cm$^2$ or higher in order to increase the relative density of the resultant sintered body. If the molding pressure is lower than 200 kg/cm$^2$, the relative density of the resultant sintered body is lowered, and this can decrease the heat capacity per unit volume.

The molded product is placed in a carbon vessel and heated to carbonize the organic compound contained in the molded product. Although the temperature, atmosphere, and time in this carbonization step depend upon the type of organic compound used, it is desirable to perform the step at a temperature of 400° to 800° C. in a vacuum or in an inert gas atmosphere. Since, however, the organic compound readily volatilizes in the form of a hydrocarbon if the treatment is done in a vacuum atmosphere, it is favorable to perform the treatment in an inert gas atmosphere in respect of carbonization. More specifically, it is possible to carbonize the polyvinylpyrrolidone by treating at a temperature of 600° C. for about one hour in a nitrogen or argon gas atmosphere. Thereafter, the molded product thus carbonized is sintered as it is held in a vacuum or in an inert gas at a temperature of 1300° to 1800° C. for one to four hours, thereby manufacturing a sintered body. In this sintering step, the temperature can be once decreased to room temperature after the carbonization and then increased again to sinter the molded product.

The above sintered body manufacturing step can also be performed by using a granulated material which is prepared by mixing the first and second mixtures at a predetermined ratio after these mixtures are carbonized, milling the resultant mixture with an organic solvent and a molding binder, again mixing the resultant material into a slurry, and lastly removing the solvent from the slurry by using, e.g., a spray dryer. A molded product formed from the granulated material thus prepared is sintered into a sintered body after the molding binder is degreased, without being passed through the carbonization step.

The mixing ratio of the second granulated material for forming the second regions to the first granulated material for forming the first regions containing a small amount of carbon or not containing carbon is preferably 20 to 50 wt. %, for the reasons explained below. That is, if the mixing ratio of the second granulated material for forming the second regions is lower than 20 wt. %, it may become difficult to electrically connect the second regions together in the manufactured sintered body. On the other hand, if the mixing ratio of the second granulated material is higher than 50 wt. %, the resistivity of the manufactured sintered body becomes close to that of the second regions. This may make it impossible to obtain the intended resistor.

The mixing ratio of the second mixture to the first mixture when the two are carbonized as described above also is preferably 20 to 50 wt. %, for the same reasons as when the first and second granulated materials are used.

The two major surfaces of the resultant sintered body are polished, and on these polished surfaces electrodes made from any of a metal such as aluminum or nickel, a carbide of Hf, Nb, Ta, or Ti, or TiN are formed by means such as sputtering, flame spray coating, or baking. Thereafter, an insulating layer is formed on the outer circumferential surface of the sintered body by, e.g., baking, coating, or drying ceramic such as aluminum oxide, silicon oxide, or borosilicate glass, or an insulating heat-resistant resin such as a polyimide, thereby completing the manufacture of a resistor.

In the manufacturing method according to the present invention as described above, a solution prepared by dissolving an organic compound as a carbon precursor in a solvent is dispersed in an aluminum oxide powder. After the solvent is removed, the resultant material is granulated to prepare a first granulated material for forming first regions containing a small amount of carbon or not containing carbon. Likewise, a solution prepared by dissolving an organic compound as a carbon precursor in a solvent is dispersed in an aluminum oxide power. After the solvent is removed, the resultant material is granulated to prepare a second granulated material for forming second regions containing a larger amount of carbon than in the first regions. By mixing the first and second granulated materials and molding and sintering the resultant mixture, it is possible to manufacture a sintered body which consists of first regions containing a small amount of carbon or not containing carbon and second regions containing a larger amount of carbon than in the first regions, and in which the second regions are connected together by the three-dimensional network structure. As a result, a sintered body having a stable resistivity can be manufactured without being influenced by the sintering atmosphere, the temperature distribution, or the like factor. By forming electrodes on the two major surfaces of this sintered body, it is possible to manufacture a power resistor, which includes the sintered body having an appropriate and stable electrical resistance, with a high yield.

Also, the first granulated material containing a small amount of carbon or not containing carbon and the second granulated material containing a larger amount of carbon than in the first granulated material are mixed and molded, and the resultant molded product is sintered. As a consequence, a dense sintered body can be manufactured since the sintering properties are determined by the first granulated material which contains a small amount of carbon or does not contain carbon. The result is a power resistor improved in the heat capacity per unit volume. At the same time, the growth of the aluminum oxide particles is encouraged in the molded product in which the first granulated material exists, and discouraged in the molded product in which the second granulated material containing a large amount of carbon exists. The result is that the particle size of the aluminum oxide particles in the first regions becomes larger than the particle size of the aluminum oxide particles in the second regions. That is, the sintered body is formed by the first and second regions having the aluminum oxide particles with different particle sizes. This allows manufacture of a power resistor improved in the absorption of switching surge.

Another power resistor according to the present invention will be described below.

Figure 4:
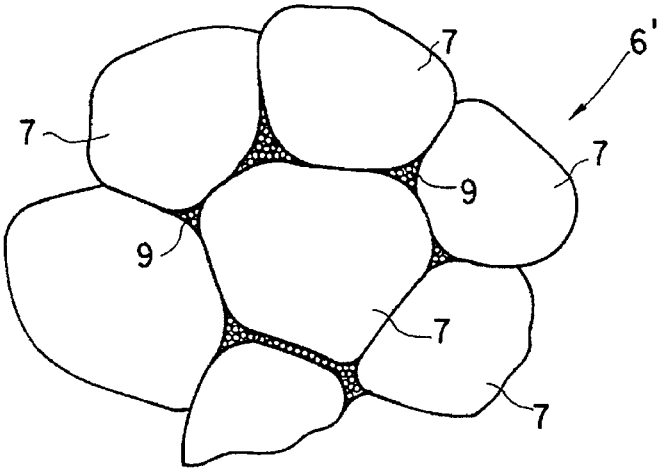
FIG. 4 is a view schematically showing, in an enlarged scale, a second region in a sintered body of another power resistor according to the present invention.

As with the power resistor illustrated in FIG. 1, this power resistor also is constituted by a disk-like sintered body, a pair of electrodes formed on the two circular surfaces of the sintered body, and an insulating layer formed on the outer circumferential surface of the sintered body. The sintered body has a composition containing an aluminum oxide powder and a carbon powder. The sintered body consists of first regions containing a small amount of the carbon powder or not containing the carbon powder and second regions containing a larger amount of the carbon powder than in the first regions. The first regions are essentially insulating, and the second regions are conductive. In this sintered body, the second regions are connected together by a three-dimensional network structure and so arranged as to be connected to the electrodes. The resistance of the sintered body is controlled by this connected state of the second regions and by the resistivity of the second regions themselves. As illustrated in FIG. 4, in each second region 6', conductive carbon powders 9 mainly exist at the triple points of the grain boundary of aluminum oxide particles 7. The second regions 6' are electrically connected together by this carbon powder 9.

It is preferable that the first regions occupy a greater part of the sintered body and the second regions occupy the remaining part of the body, and that the carbon powder present in the second regions electrically connect the pair of electrodes. It is particularly desirable that the first regions occupy 40 to 80 wt. % of the sintered body and the second regions occupy 20 to 60 wt. % thereof. If the sintered body consists of the first regions and the second regions in this weight percentage, it is desirable that the carbon powder accounts for 0.3 to 5 wt. %, with the first regions containing less than 1.0 wt. % (including 0 wt. %) of carbon powder and the second regions containing 1.0 to 10 wt. % of carbon powder. The reason for this specific carbon powder content is as follows.

If, the carbon powder amount in the sintered body is smaller than 0.3 wt. %, carbon powder does not exhibit its conductivity well. As a result, the resistivity of the sintered body becomes $10^5$ Ω·cm or higher, which is too high as the resistivity of a power resistor. On the other hand, a carbon powder amount larger than 5 wt. % results in a low electrical resistance of 10 Ω·cm or lower and also lowers the denseness of the sintered body. Therefore, this carbon powder amount also is inadequate for a power resistor. The carbon powder amount in the sintered body is more preferably 0.5 to 2 wt. %.

If the carbon powder content in the first regions is more than 1.0 wt. %, the first region does not have insulating properties.

The resistivity of the second regions is controlled by the content of the carbon powder. If the carbon powder content in the second regions is smaller than 1.0 wt. %, the resulting resistivity is $10^5$ Ω·cm or higher, which is too high as the resistivity of a power resistor. If, on the other hand, the carbon powder content in the second regions exceeds 10 wt. %, the denseness of the sintered body lowers, and this makes it difficult to obtain the effect of the present invention. The carbon powder content in the second region is more preferably 2 to 5 wt. %.

If the first regions contain relatively much carbon powder in an amount less than 1.0 wt. %, the electrodes are electrically connected not only by the carbon contained in the second regions, but also by the carbon contained in the first regions.

The particle size of the aluminum oxide particles in the second regions is preferably smaller than that of the aluminum oxide particles in the first regions. More specifically, it is desirable that the aluminum oxide particles in the second regions have a mean particle size of 0.2 to 0.5 μm, and the aluminum oxide particles in the first regions have a particle size 2 to 8 times, more preferably 3 to 6 times as large as the particle size of the aluminum oxide particles in the second regions. A power resistor including the sintered body consisting of the first and second regions containing aluminum oxide particles of different particle sizes is improved in the switching surge absorption.

The sintered body described above preferably has a high-resistance layer, which has a particle size larger than that of the aluminum oxide particles in the interior of the sintered body and also has a high resistance, on the outer surface excluding the electrodes. This high-resistance layer preferably has a thickness of 50 to 1000 μm. The mean particle size of the aluminum oxide particles constituting the high-resistance layer is preferably 1.2 to 2 times as large as the mean particle size of the aluminum oxide particles in the first regions in the interior of the sintered body. A power resistor including the sintered body having this high-resistance layer on the outer surface is improved in the insulating properties and the injection energy resistance. Therefore, the power resistor can be used at high temperatures with high voltages and large injection energy.

The sintered body may contain an impurity such as aluminum oxynitride or aluminum oxycarbide, provided the amount of the impurity is not so large as to affect the thermal capacity of the sintered body.

The electrodes are preferably constructed from a metal such as aluminum or nickel, a carbide of Hf, Nb, Ta, or Ti, or TiN.

The insulating layer is formed on the circumferential surface of the sintered body in order to prevent creeping discharge on that surface. The insulating layer is preferably made from ceramic such as aluminum oxide, silicon oxide, or borosilicate glass, or from an insulating heat-resistant resin such as a polyimide.

In the power resistor according to the present invention described above, the sintered body consists of the first regions containing a small amount of the carbon powder or not containing the carbon powder and the second regions containing a larger amount of the carbon powder than in the first regions. The first regions are essentially insulating, and the second regions are conductive. The second regions are connected together by a three-dimensional network structure and so arranged as to be connected to the electrodes. Since this sintered body has a high denseness, a resistor including the sintered body has a high strength and is also improved in the heat capacity per unit volume.

As described above, the second regions are connected together by a three-dimensional network structure and so arranged as to be connected to the electrodes. Consequently, it is possible to realize a power resistor including a sintered body having an appropriate and stable electrical resistance.

Additionally, the resistance of the sintered body can be controlled by the connected state of the second regions and the resistivity of the second regions themselves. That is, while keeping a sufficient number of connections between the second regions, it is possible to properly increase the resistivity of, i.e., decrease the carbon powder content of the second regions which exhibit conductivity. This makes it possible to obtain a sintered body with a relatively high and stable resistivity.

Furthermore, the sintered body has the second regions which are connected together by a three-dimensional network structure and so arranged as to be connected to the electrodes. Accordingly, a resistor including this sintered body can maintain its resistivity stable against energy absorption such as surge. This results in a small change in the resistance with time.

In particular, a power resistor including a sintered body which has a total carbon powder amount of 0.3 to 5 wt. % and consists of first regions whose carbon powder amount is less than 1.0 wt. % (including 0 wt. %) and second regions whose carbon powder amount is 1.0 to 10 wt. % notably exhibits the above characteristics; that is, in this resistor the heat capacity per unit volume is large, the electrical resistance is proper and stable, the resistivity is kept stable against energy absorption such as surge, and the resistance changes little with time.

A method of manufacturing the power resistor described above will be described in detail below.

First, an aluminum oxide powder with a mean particle size of 1 μm or smaller, preferably 0.5 μm or smaller with which good sintering properties are obtained and a carbon powder with a particle size of 0.1 μm or smaller are milled in the presence of water or an organic solvent in a ball mill. In this step, a first powder mixture containing a small amount of the carbon powder or not containing the carbon powder and a second powder mixture containing a larger amount of the carbon powder than in the first powder mixture are prepared.

Subsequently, first and second granulated materials are prepared by adding, if necessary, a molding binder such as paraffin or polyvinyl alcohol to the first and second powder mixtures and passing the resultant materials through a mesh with a predetermined mesh size. Note that if this binder is to be used as a carbon source of a sintered body, it is preferable to adjust the amount of the carbon powder by taking into account the addition amount of the binder. In addition to the above method, it is also possible to prepare the first and second granulated materials by preparing slurries by mixing the first and second powder mixtures with an organic solvent and a molding binder, and removing the solvent from these slurries by using, e.g., a spray dryer.

Subsequently, the first and second granulated materials thus prepared are mixed at a predetermined ratio by, e.g., a V mixer and molded into a molded product. As the molding means it is possible to use, e.g., mold pressing, an extrusion process, or injection molding. When mold pressing is to be used, the process is preferably performed at a pressure of 200 kg/cm$^2$ or higher in order to increase the relative density of the resultant sintered body. If the molding pressure is lower than 200 kg/cm$^2$, the relative density of the resultant sintered body is lowered, and this can decrease the heat capacity per unit volume.

The molded product is degreased by a heat treatment and sintered as it is held in a vacuum or in an inert gas at a temperature of 1300° to 1800° C. for one to four hours, thereby manufacturing a sintered body. In this sintering step, the temperature can be once decreased to room temperature after the degreasing and then increased again to sinter the molded product.

The mixing ratio of the second granulated material for forming the second regions to the first granulated material for forming the first regions containing a small amount of the carbon powder or not containing the carbon powder is preferably 20 to 60 wt. %, for the reasons explained below. That is, if the mixing ratio of the second granulated material for forming the second regions is lower than 20 wt. %, it may become difficult to electrically connect the second regions together in the manufactured sintered body. On the other hand, if the mixing ratio of the second granulated material is higher than 60 wt. %, the resistivity of the manufactured sintered body approaches that of the second regions. This may make it impossible to obtain the intended resistor.

The two major surfaces of the resultant sintered body are polished, and on these polished surfaces electrodes made from any of a metal such as aluminum or nickel, a carbide of Hf, Nb, Ta, or Ti, or TiN are formed by means such as sputtering, flame spray coating, or baking. Thereafter, an insulating layer is formed on the outer circumferential surface of the sintered body by, e.g., baking, coating, or drying ceramic such as aluminum oxide, silicon oxide, or borosilicate glass, or an insulating heat-resistant resin such as a polyimide, thereby completing the manufacture of a resistor.

In the manufacturing method according to the present invention as described above, the first granulated material for forming the first regions containing a small amount of a carbon powder or not containing the carbon powder and the second granulated material for forming the second regions containing a larger amount of the carbon powder than in the first regions are mixed, and the resultant mixture is molded and sintered. Consequently, it is possible to manufacture a sintered body which consists of first regions containing a small amount of a carbon powder or not containing the carbon powder and second regions containing a larger amount of the carbon powder than in the first regions, and in which the second regions are connected together by a three-dimensional network structure. As a result, a sintered body having a stable resistivity can be manufactured without being influenced by the sintering atmosphere, the temperature distribution, or the like factor. By forming electrodes on the two major surfaces of this sintered body, it is possible to manufacture a power resistor, which includes a sintered body having an appropriate and stable electrical resistance, with a high yield.

Also, the first granulated material containing a small amount of the carbon powder or not containing the carbon powder and the second granulated material containing a larger amount of the carbon powder than in the first granulated material are mixed and molded, and the resultant molded product is sintered. As a consequence, a dense sintered body can be manufactured since the sintering properties are determined by the first granulated material which contains a small amount of the carbon powder or does not contain the carbon powder. The result is a power resistor improved in the heat capacity per unit volume. At the same time, the growth of the aluminum oxide particles is encouraged in the molded product in which the first granulated material exists, and discouraged in the molded product in which the second granulated material containing a large amount of the carbon powder exists. The result is that the particle size of the aluminum oxide particles in the first regions becomes larger than the particle size of the aluminum oxide particles in the second regions. That is, the sintered body is formed by the first and second regions having the aluminum oxide particles with different particle sizes. This allows manufacture of a power resistor improved in the absorption of switching surge.

Figure 5:
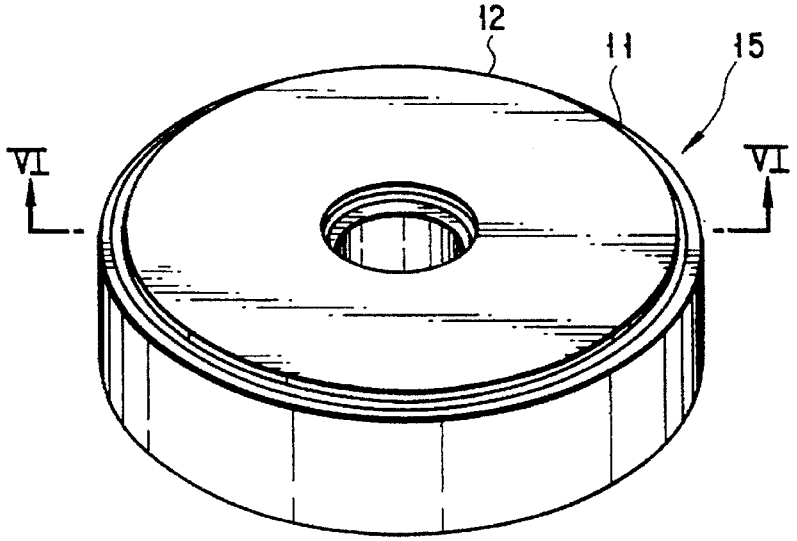
FIG. 5 is a perspective view showing another form of the power resistor according to the present invention.
Figure 6:
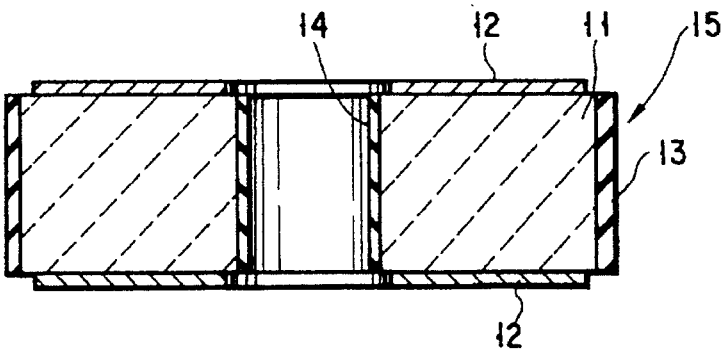
FIG. 6 is a sectional view taken along the line VI—VI of the power resistor in FIG.

Note that the structure of the power resistor according to the present invention is not restricted to the above-mentioned structure having a disk-like shape. As an example, as illustrated in FIGS. 5 and 6, it is possible to constitute a power resistor 15 by using an annular sintered body 11, electrodes 12 formed on the two annular opposing surfaces of the sintered body 11, and insulating layers 13 and 14 coated on the outer circumferential surface and the inner circumferential surface, respectively, of the sintered body 11.

The power resistor according to the present invention can be applied to a closing resistor of a power circuit breaker (to be described below), or to a fixed resistor, a variable resistor, or a resistor array for use in a high-voltage apparatus or in a charger/discharger of a capacitor with a large capacitance.

A power circuit breaker according to the present invention will be described below with reference to FIGS. 7 and 8.

Figure 7:
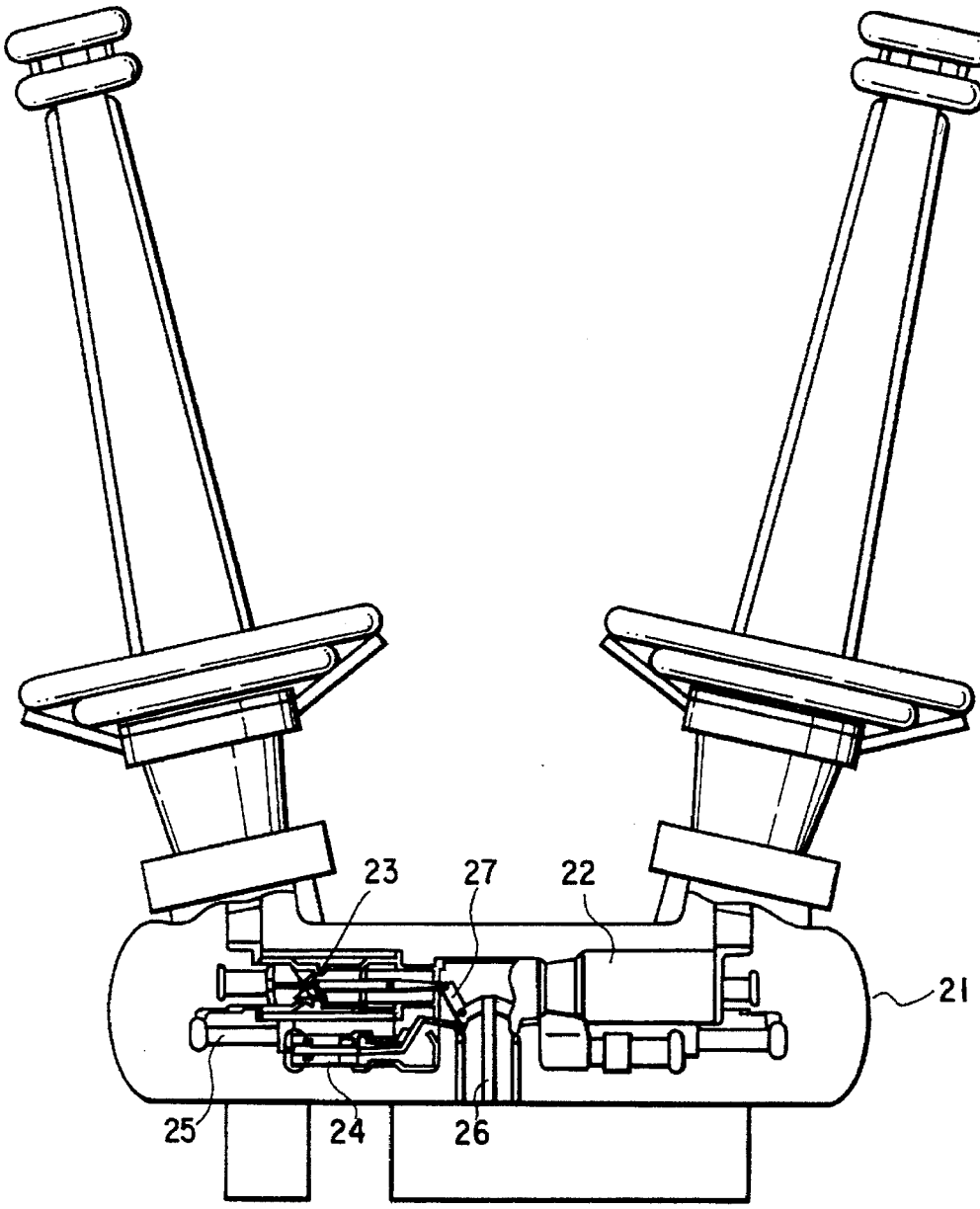
FIG. 7 is a view showing the arrangement of a power circuit breaker according to the present invention.
Figure 8:
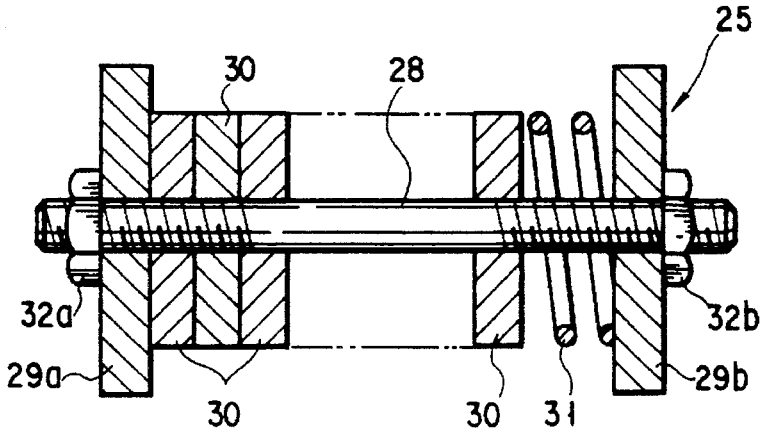
FIG. 8 is a sectional view showing the arrangement of a closing resistor unit as a constituent element of the power breaker in FIG. 7.

FIG. 7 is a view showing the arrangement of a power circuit breaker according to the present invention, and FIG. 8 is a sectional view showing a closing resistor. A power circuit breaker 21 includes a main connection point 23 arranged in an arc extinguish chamber 22 and connected to a current path. An auxiliary connection point 24 is connected to the current path parallel with respect to the main connection point 23. A closing resistor unit 25 is connected in series with the auxiliary connection point 24. An insulating rod 26 which is vertically moved is connected to a switch 27 which is titled.

In the power circuit breaker with above arrangement, when the insulating rod 26 is driven upward, the switch 27 is tilted to turn on the auxiliary connection point 24 before the main connection point 23 is turned on. At this time, since the closing resistor unit 25 is connected in series with the auxiliary connection point 24, the voltage of the current flowing through the current path interposed with the auxiliary connection point 24 can be dropped to that of the closing resistor unit 25. As a result, an arc can be prevented from being generated in the ON state of the auxiliary connection point 24. Also, immediately before the main connection point 23 is turned on the current flows through the closing resistor unit 25 and the current path in which the auxiliary connection point 24 is inserted, and no current flows through the current path in which the main connection point 23 is inserted. Therefore, no high voltage is applied to the main connection point 23 when the main connection point 23 is turned on. Consequently, an arc can be prevented from being generated in the ON state of the main connection point 23.

As in FIG. 8, the closing resistor unit 25 is mainly constituted by an insulating support shaft 28, a pair of insulating support plates **29*a* and 29*b*, a plurality of hollow cylindrical resistors 30, and an elastic member 31. The insulating support plates 29*a* and 29*b* are fitted on the support shaft 28. The hollow cylindrical resistors 30 are fitted on a portion of the support shaft 28 positioned between the support plates 29*a* and 29*b*. The elastic member 31 is arranged between the support plate 29*b* (on the right side) and the resistors 30 and fitted on the support shaft 28. The elastic member 31 gives an elastic force to the resistors 30 to stack them through the support shaft 28. Nuts 32*a* and 32*b* are threadably engaged with the two end portions of the support shaft 28. These nuts 32*a* and 32*b* push the elastic member 31 arranged between the support plates 29*a* and 29*b*. The insulating support shaft 28** is constructed from an organic material to obtain a high strength, a light weight, and an easy processability. Generally, a closing resistor has a temperature rise when absorbing switching surge. This makes it difficult for the support shaft, which is made from the organic material with a low heat resistance, to maintain its strength. However, a closing resistor having a composition to be described below has a large heat capacity and hence can decrease the temperature rise upon absorption of switching surge to a predetermined temperature or lower. This permits the use of the support shaft made from an organic material. Also, the volume of a closing resistor can be decreased as the heat capacity of the resistor is increased.

As illustrated in FIGS. 5 and 6, each of the resistors (power resistors) 30 incorporated into the closing resistor unit 25 consists of the annular sintered body 11, the electrodes 12 formed on the two annular surfaces of the sintered body 11, and the insulating layers 13 and 14 formed on the outer circumferential surface and the inner circumferential surface, respectively, of the sintered body 11. This sintered body has a composition containing aluminum oxide and carbon. The sintered body consists of first regions containing a small amount of a carbon or not containing the carbon and second regions containing a larger amount of the carbon than in the first regions. The first regions are essentially insulating, and the second regions are conductive. In this sintered body, the second regions are connected together by a three-dimensional network structure and so arranged as to be connected to the electrodes. The resistance of the sintered body is controlled by the connected state of the second regions and the resistivity of the second regions themselves. In each of these second regions, conductive carbon mainly exists at the triple points of the grain boundary of the aluminum oxide particles. The second regions are electrically connected together by this carbon.

The power circuit breaker according to the present invention as described above includes a closing resistor unit incorporating resistors each of which includes a sintered body with the above arrangement and has a large heat capacity per unit volume, and in which the resistance meeting the intended purpose varies little with time. This closing resistor unit has a large breaking capacity, so the volume of the resistor unit can be decreased compared to that of a closing resistor unit which incorporates conventional carbon dispersed ceramic resistors. The closing resistor unit also has a stable breaking performance. Therefore, a power circuit breaker including this closing resistor unit can be decreased in size and improved in performance.

The present invention will be described in more detail below by way of its preferred examples.

EXAMPLES 1–3

5 wt. % (solid content) of paraffin as a molding binder were added to an aluminum oxide powder with a mean particle size of 0.2 μm, and the resultant material was formed into a slurry by using xylene as a solvent. The slurry was dried and granulated to prepare a first granulated material.

Separately, predetermined amounts of a methanol solution of polyvinylpyrrolidone as a carbon source were added to an aluminum oxide powder with a mean particle size of 0.2 μm. Each resultant material was mixed and milled by using an alumina pot and alumina balls. The resultant slurries were dried under stirring in an alumina vessel and added with 5 wt. % (solid content) of paraffin as a molding binder. The resultant materials were again formed into slurries by using xylene as a solvent. The obtained slurries were dried and granulated to prepare three types of second granulated materials different in the amount of the carbon source.

Subsequently, 20 wt. % of each of the second granulated materials were added to the first granulated material, respectively, and each resultant material was mixed by a V-type mixer, thereby preparing three different granulated material mixtures. These granulated material mixtures were then molded into cylindrical disks by using a steel mold and carbonized by heating in a nitrogen gas atmosphere at 600° C. The resultant materials were sintered in an argon gas atmosphere at 1500° C. for two hours, thereby forming three types of sintered bodies. Subsequently, a borosilicate glass powder was coated and baked on the outer circumferential surface of each sintered body, forming an insulating layer on the surface. Thereafter, the two circular major surfaces of each resultant sintered body were polished and processed into an annular shape with an outer diameter of 120 mm, an inner diameter of 35 mm, and a thickness of 25 mm. After the two major surfaces of each sintered body were cleaned, aluminum electrodes were formed on these surfaces by flame spray coating, thereby manufacturing three types of power resistors.

EXAMPLES 4 & 5

Predetermined amounts of a methanol solution of polyvinylpyrrolidone as a carbon source were added to an aluminum oxide powder with a mean particle size of 0.2 μm. Each resultant material was mixed and milled by using an alumina pot and alumina balls. The resultant slurries were dried under stirring in an alumina vessel and added with 5 wt. % (solid content) of paraffin as a molding binder. The resultant materials were again formed into slurries by using xylene as a solvent. The obtained slurries were dried and granulated to prepare two types of second granulated materials different in the amount of the carbon source.

Subsequently, 30 wt. % of each of the second granulated materials were added to a first granulated material analogous to that in Example 1, respectively, and each resultant material was mixed by a V-type mixer, thereby preparing two different granulated material mixtures. Thereafter, following the same procedure as in Example 1, two types of sintered bodies were manufactured from these granulated material mixtures. In addition, the formation of an insulating layer, the polishing, the processing, and the formation of electrodes were performed in the same procedure as in Example 1, manufacturing two types of power resistors.

EXAMPLES 6 & 7

Predetermined amounts of a methanol solution of polyvinylpyrrolidone as a carbon source were added to an aluminum oxide powder with a mean particle size of 0.2 μm. Each resultant material was mixed and milled by using an alumina pot and alumina balls. The resultant slurries were dried under stirring in an alumina vessel and added with 5 wt. % (solid content) of paraffin as a molding binder. The resultant materials were again formed into slurries by using xylene as a solvent. The obtained slurries were dried and granulated to prepare two types of second granulated materials different in the amount of the carbon source.

Subsequently, 40 wt. % of each of the second granulated materials were added to a first granulated material analogous to that in Example 1, respectively, and each resultant material was mixed by a V-type mixer, thereby preparing two different granulated material mixtures. Thereafter, following the same procedure as in Example 1, two types of sintered bodies were manufactured from these granulated material mixtures. In addition, the formation of an insulating layer, the polishing, the processing, and the formation of electrodes were performed in the same manner as in Example 1, manufacturing two types of power resistors.

EXAMPLE 8

A predetermined amount of a methanol solution of polyvinylpyrrolidone as a carbon source was added to an aluminum oxide powder with a mean particle size of 0.2 μm. The resultant material was mixed and milled by using an alumina pot and alumina balls. The resultant slurry was dried under stirring in an alumina vessel and added with 5 wt. % (solid content) of paraffin as a molding binder. The resultant material was again formed into a slurry by using xylene as a solvent. The obtained slurry was dried and granulated to prepare a first granulated material. A portion of the resultant material was sampled and heated in an argon atmosphere at 1500° C. The carbon content was found to be 0.2 wt. %.

Subsequently, 50 wt. % of a second granulated material similar to that in Example 6 were added to the first granulated material, and the resultant material was mixed by a V-type mixer, thereby preparing a granulated material mixture. Thereafter, following the same procedure as in Example 1, a sintered body was manufactured from this granulated material mixture. In addition, the formation of an insulating layer, the polishing, the processing, and the formation of electrodes were performed in the same manner as in Example 1, manufacturing a power resistor.

EXAMPLES 9 & 10

A predetermined amount of a methanol solution of polyvinylpyrrolidone as a carbon source was added to an aluminum oxide powder with a mean particle size of 0.2 μm. After being mixed and dried, the resultant material was heated in nitrogen gas at 600° C. to carbonize the polyvinylpyrrolidone, thereby preparing a second region formation mixture. Subsequently, two portions of the mixture were added in different mixing amounts to an aluminum oxide powder (first region formation powder) with a mean particle size of 0.2 μm. Each resultant mixture and paraffin as a molding binder were dispersed in xylene under stirring. The resultant slurries were dried and granulated to prepare two different granulated materials. Thereafter, following the same procedure as in Example 1, two types of sintered bodies were manufactured from these granulated materials. In addition, the formation of an insulating layer, the polishing, the processing, and the formation of electrodes were performed in the same way as in Example 1, manufacturing two types of power resistors.

COMPARATIVE EXAMPLES 1–4

Predetermined amounts of a methanol solution of polyvinylpyrrolidone as a carbon source were added to an aluminum oxide powder with a mean particle size of 0.2 μm. Each resultant material was mixed and milled by using an alumina pot and alumina balls. The resultant slurries were dried under stirring in an alumina vessel and added with 5 wt. % (solid content) of paraffin as a molding binder. The resultant materials were again formed into slurries by using xylene as a solvent. The obtained slurries were dried and granulated to prepare four types of granulated materials different in the amount of the carbon source. Thereafter, following the same procedure as in Example 1, four type of sintered bodies were manufactured from these granulated materials. In addition, the formation of an insulating layer, the polishing, the processing, and the formation of electrodes were performed in the same manner as in Example 1, manufacturing four types of power resistors.

Various characteristics of the power resistors obtained in Examples 1 to 10 and Comparative Examples 1 to 4 were measured. The measured characteristics were: the ratio of the second regions in the sintered body; the carbon contents in first and second regions of the sintered body; the carbon amount in the entire sintered body; the mean particle size of the aluminum oxide particles in the first regions; the mean particle size of the aluminum oxide particles in the second regions; the resistivity; the intra-resistor resistance ratio; and the inter-resistor resistance ratio. The measurement results are summarized in Table 1 (to be presented later). Note that the carbon content in the first and the second regions, the carbon amount in the entire sintered body, the mean particle sizes of the aluminum oxide particles in the first and second regions, and the intra- and inter-resistor resistance ratios were measured by the following the methods.

(1) Carbon content in first regions

A portion of the first granulated material or of the first region formation mixture was sampled and filled into a graphite vessel. The sample was heated in an argon atmosphere at 1500° C. to carbonize the polyvinylpyrrolidone as an organic compound, thereby coating carbon on the surface of the aluminum oxide powder. The carbon content was measured by analyzing the powder according to an RF combustion heating infrared absorption method. For convenience, this value was used as the carbon amount in the first regions.

(2) Carbon content in second regions

A portion of the second granulated material or of the second region formation mixture was sampled and filled into a graphite vessel. Thereafter, following the same procedure as in carbon content in first regions (1), the carbon amount in the second regions was measured by using the sample.

(3) Carbon amount in entire sintered body

The carbon amount in the entire sintered body was measured by crushing sintered bodies of the same lot and analyzing the crushed sintered bodies by the RF combustion heating infrared absorption method.

(4) Mean grain sizes of aluminum oxide particles in first and second regions

The mean grain sizes of the aluminum oxide particles in the first and second regions were measured by observing the section of a cracked sintered body with an electron microscope.

(5) Intra-resistor resistance ratio

One of the electrodes of the resistor was removed, and 20 aluminum electrodes 3 mm in diameter were evenly formed on the exposed surface of the sintered body. The resistance between each of these electrodes and the other electrode previously formed was measured, and the ratio of the maximum value to the minimum value measured was used as the intra-resistor resistance ratio. In practical use, the intra-resistor resistance ratio is preferably 10 or lower.

(6) Inter-resistor resistance ratio

The resistances of 20 resistors of the same lot were measured, and the ratio of the maximum value to the minimum value measured was used as the inter-resistor resistance ratio. In practical use, the inter-resistor resistance ratio is preferably 5 or lower.

TABLE 1A

| | Ratio of 2nd regions in sintered body (wt %) | Carbon amount of 1st regions (wt %) | Carbon amount of 2nd regions (wt %) | Carbon amount of sintered body (wt %) | Mean particle size of aluminum oxide particles (μm) 1st regions | 2nd regions |
|---|---|---|---|---|---|---|
| Comparative Example 1 | — | — | — | 0.3 | — | — |
| Comparative Example 2 | — | — | — | 0.2 | — | — |
| Comparative Example 3 | — | — | — | 0.1 | — | — |
| Comparative Example 4 | — | — | — | 0.04 | — | — |
| Example 1 | 20 | <0.1 | 4.9 | 0.9 | 1.3 | 0.3 |
| Example 2 | 20 | <0.1 | 3.4 | 0.6 | 1.3 | 0.3 |
| Example 3 | 20 | <0.1 | 2.2 | 0.4 | 1.5 | 0.3 |
| Example 4 | 30 | <0.1 | 2.2 | 0.7 | 1.3 | 0.3 |
| Example 5 | 30 | <0.1 | 0.7 | 0.2 | 1.7 | 0.4 |
| Example 6 | 40 | <0.1 | 0.7 | 0.3 | 1.5 | 0.4 |
| Example 7 | 40 | <0.1 | 0.5 | 0.2 | 1.7 | 0.4 |
| Example 8 | 50 | 0.2 | 0.7 | 0.4 | 1.5 | 0.3 |
| Example 9 | 20 | <0.1 | 3.7 | 0.7 | 1.4 | 0.3 |
| Example 10 | 40 | <0.1 | 0.8 | 0.3 | 1.5 | 0.4 |

TABLE 1B

| | Resistivity (Ω · cm) | Intra-resistor resistance ratio | Inter-resistor resistance ratio |
|---|---|---|---|
| Comparative Example 1 | $1.5 \times 10^3$ | 12 | 5.6 |
| Comparative Example 2 | $5.4 \times 10^3$ | 18 | 8.2 |
| Comparative Example 3 | $7.5 \times 10^4$ | 83 | 27 |
| Comparative Example 4 | $3.0 \times 10^6$ | 450 | 93 |
| Example 1 | $2.1 \times 10^3$ | 2.2 | 2.4 |
| Example 2 | $1.0 \times 10^4$ | 8.3 | 3.6 |
| Example 3 | $2.5 \times 10^4$ | 9.5 | 4.3 |
| Example 4 | $3.2 \times 10^3$ | 2.8 | 2.1 |
| Example 5 | $2.2 \times 10^4$ | 8.6 | 3.8 |

TABLE 1B-continued

| | Resistivity (Ω · cm) | Intra-resistor resistance ratio | Inter-resistor resistance ratio |
|---|---|---|---|
| Example 6 | $4.5 \times 10^3$ | 7.8 | 3.2 |
| Example 7 | $1.6 \times 10^4$ | 9.6 | 4.1 |
| Example 8 | $3.3 \times 10^3$ | 2.6 | 2.0 |
| Example 9 | $9.0 \times 10^3$ | 8.0 | 3.2 |
| Example 10 | $4.1 \times 10^3$ | 5.4 | 2.5 |

As can be seen from Table 1A and 1B, even if the power resistor including the sintered body having the first regions and the second regions with a larger carbon content than in the first regions was a high-resistance resistor (each of Examples 1 to 8) whose resistivity exceeded $10^3$ Ω·cm, it was possible to uniformly and stably manufacture the resistor such that the intra-resistor resistance ratio was low, 10 or lower, and the inter-resistor resistance ratio was as low as 5 or lower. Also, as indicated by Examples 9 and 10, even if the order of the treatment steps of the materials was reversed, it was possible to obtain resistors having superior characteristics such as in Examples 1 to 8 by the use of the sintered body having the first regions and the second regions with a larger carbon content than in the first regions.

Additionally, a surge voltage equivalent to energy of 200 J/cm$^3$ was applied to the power resistors of Examples 1 to 10 repetitively at predetermined intervals to allow the resistors to be cooled, and the resistance, R, of each resistor was measured. Assuming the initial value was $R_0$, the resistance change was calculated from the following equation:

$$\text{Resistance change (\%)}=[(R-R_0)/R_0]\times 100$$

Note that the resistance change is preferably 10% or lower.

As a result, each resistor had a resistance change of 10% or less, indicating a high stability against surge absorption. Also, the sintered bodies of the resistors in Examples 1 to 10 were dense, i.e., had relative densities of 95% or higher. Therefore, each of these resistors was good for a power resistor because of its large heat capacity of nearly 3 J/cm$^3$.

EXAMPLES 11–13

5 wt. % (solid content) of paraffin as a molding binder were added to an aluminum oxide powder with a mean particle size of 0.2 μm, and the resultant material was formed into a slurry by using xylene as a solvent. The slurry was dried and granulated to prepare a first granulated material.

Separately, predetermined amounts of a carbon powder with a mean particle size of 50 nm as a carbon source were added to an aluminum oxide powder with a mean particle size of 0.2 μm. Each resultant material was mixed and milled by using an alumina pot and alumina balls. The resultant slurries were dried under stirring in an alumina vessel and added with 5 wt. % (solid content) of paraffin as a molding binder. The resultant materials were again formed into slurries by using xylene as a solvent. The obtained slurries were dried and granulated to prepare three types of second granulated materials containing 9.5 wt. %, 4.8 wt. %, and 3.1 wt. % of the carbon powder.

Subsequently, 20 wt. % of each of the second granulated materials were added to the first granulated material, respectively, and each resultant material was mixed by a V-type mixer, thereby preparing three different granulated material mixtures. These granulated material mixtures were then molded into cylindrical disks by using a steel mold and carbonized by heating in a nitrogen gas atmosphere at 600° C. The resultant materials were sintered in an argon gas atmosphere at 1500° C. for two hours, thereby forming three types of sintered bodies. Subsequently, a borosilicate glass powder was coated and baked on the outer circumferential surface of each sintered body, forming an insulating layer on the surface. Thereafter, the two circular major surfaces of each resultant sintered body were polished into an annular shape with an outer diameter of 120 mm, an inner diameter of 35 mm, and a thickness of 25 mm. After the two major surfaces of each sintered body were cleaned, aluminum electrodes were formed on these surfaces by flame spray coating, thereby manufacturing three types of power resistors.

EXAMPLES 14–17

Predetermined amounts of a carbon powder with a mean particle size of 50 nm were added to an aluminum oxide powder with a mean particle size of 0.2 μm. Each resultant material was mixed and milled by using an alumina pot and alumina balls. The resultant slurries were dried under stirring in an alumina vessel and added with 5 wt. % (solid content) of paraffin as a molding binder. The resultant materials were again formed into slurries by using xylene as a solvent. The obtained slurries were dried and granulated to prepare four types of second granulated materials containing 9.6 wt. %, 5.0 wt. %, 2.9 wt. %, and 1.0 wt. % of the carbon powder.

Subsequently, 40 wt. % of each of the second granulated materials were added to a first granulated material analogous to that in Example 11, respectively, and each resultant material was mixed by a V-type mixer, thereby preparing four different granulated material mixtures. Thereafter, following the same procedure as in Example 11, sintered bodies were manufactured from these granulated material mixtures. In addition, the formation of an insulating layer, the polishing, the processing, and the formation of electrodes were performed in the same procedure as in Example 11, manufacturing four types of power resistors.

EXAMPLES 18–20

Predetermined amounts of a carbon powder with a mean particle size of 50 nm were added to an aluminum oxide powder with a mean particle size of 0.2 μm. Each resultant material was mixed and milled by using an alumina pot and alumina balls. The resultant slurries were dried under stirring in an alumina vessel and added with 5 wt. % (solid content) of paraffin as a molding binder. The resultant materials were again formed into slurries by using xylene as a solvent. The obtained slurries were dried and granulated to prepare three types of second granulated materials containing 4.9 wt. %, 3.0 wt. %, and 1.1 wt. % of the carbon powder.

Subsequently, 60 wt. % of each of the second granulated materials were added to a first granulated material similar to that in Example 11, respectively, and each resultant material was mixed by a V-type mixer, thereby preparing four different granulated material mixtures. Thereafter, following the same procedure as in Example 11, sintered bodies were manufactured from these granulated material mixtures. In addition, the formation of an insulating layer, the polishing, the processing, and the formation of electrodes were performed in the same manner as in Example 11, manufacturing three types of power resistors.

EXAMPLE 21

A predetermined amount of a carbon powder with a mean particle size of 50 nm was added to an aluminum oxide powder with a mean particle size of 0.2 μm. The resultant material was mixed and milled by using an alumina pot and alumina balls. The resultant slurry was dried under stirring in an alumina vessel and added with 5 wt. % (solid content) of paraffin as a molding binder. The resultant material was again formed into a slurry by using xylene as a solvent. The obtained slurry was dried and granulated to prepare a first granulated material. A portion of the resultant material was sampled and heated in an argon atmosphere at 1500° C. The carbon content was found to be 2.5 wt. %. Subsequently, 40 wt. % of a second granulated material (carbon powder content 5 wt. %) similar to that in Example 15 were added to the first granulated material, and the resultant material was mixed by a V-type mixer, thereby preparing a granulated material mixture. Thereafter, following the same procedure as in Example 11, a sintered body was manufactured from this granulated material mixture. In addition, the formation of an insulating layer, the polishing, the processing, and the formation of electrodes were performed in the same manner as in Example 11, manufacturing a power resistor.

COMPARATIVE EXAMPLE 5

A predetermined amount of a carbon powder with a mean particle size of 50 nm was added to an aluminum oxide powder with a mean particle size of 0.2 μm. The resultant material was mixed and milled by using an alumina pot and alumina balls. The resultant slurry was dried under stirring in an alumina vessel and added with 5 wt. % (solid content) of paraffin as a molding binder. The resultant material was again formed into a slurry by using xylene as a solvent. The obtained slurry was dried and granulated to prepare a granulated material. Subsequently, following the same procedure as in Example 11, a sintered body was manufactured from this granulated material. In addition, the formation of an insulating layer, the polishing, the processing, and the formation of electrodes were performed in the same manner as in Example 11, manufacturing a power resistor.

Various characteristics of the power resistors obtained in Examples 11 to 21 and Comparative Example 5 were measured. The measured characteristics were: the ratio of the second regions in the sintered body; the carbon powder contents in first and second regions of the sintered body; the carbon powder amount in the entire sintered body; the mean particle size of the aluminum oxide particles in the first regions; the mean particle size of the aluminum oxide particles in the second regions; the resistivity; the intra-resistor resistance ratio; and the inter-resistor resistance ratio. The measurement results are summarized in Table 2 below. Note that the carbon powder content in the first and the second regions, the carbon powder amount in the entire sintered body, the mean particle sizes of the aluminum oxide particles in the first and second regions, and the intra- and inter-resistor resistance ratios were measured using the same methods as in Example 1 described previously.

TABLE 2A

| | Ratio of 2nd regions in sintered body (wt %) | Carbon powder amount of 1st regions (wt %) | Carbon powder amount of 2nd regions (wt %) | Carbon powder amount of sintered body (wt %) | Mean particle size of aluminum oxide particles (μm) 1st regions | 2nd regions |
|---|---|---|---|---|---|---|
| Comparative Example 5 | — | — | — | 2.0 | — | — |
| Example 11 | 20 | <0.1 | 9.5 | 1.9 | 1.5 | 0.5 |
| Example 12 | 20 | <0.1 | 4.8 | 0.9 | 1.7 | 0.6 |
| Example 13 | 20 | <0.1 | 3.1 | 0.6 | 1.7 | 0.6 |
| Example 14 | 40 | <0.1 | 9.6 | 4.0 | 1.3 | 0.4 |
| Example 15 | 40 | <0.1 | 5.0 | 1.9 | 1.4 | 0.5 |
| Example 16 | 40 | <0.1 | 2.9 | 1.2 | 1.6 | 0.6 |
| Example 17 | 40 | <0.1 | 1.0 | 0.4 | 1.7 | 0.6 |
| Example 18 | 60 | <0.1 | 4.9 | 3.1 | 1.3 | 0.4 |
| Example 19 | 60 | <0.1 | 3.0 | 1.8 | 1.4 | 0.5 |
| Example 20 | 60 | <0.1 | 1.1 | 0.6 | 1.6 | 0.6 |
| Example 21 | 40 | 0.8 | 5.0 | 2.1 | 1.4 | 0.5 |

TABLE 2B

| | Resistivity (Ω · cm) | Intra-resistor resistance ratio | Inter-resistor resistance ratio |
|---|---|---|---|
| Comparative Example 5 | $5.8 \times 10^2$ | 57 | 28 |
| Example 11 | $9.5 \times 10^3$ | 3.6 | 2.0 |
| Example 12 | $3.2 \times 10^4$ | 4.5 | 2.2 |
| Example 13 | $9.7 \times 10^4$ | 7.5 | 3.6 |
| Example 14 | $1.1 \times 10^2$ | 3.2 | 2.3 |
| Example 15 | $1.3 \times 10^3$ | 1.5 | 1.3 |
| Example 16 | $4.0 \times 10^3$ | 1.8 | 1.5 |
| Example 17 | $5.2 \times 10^4$ | 3.8 | 2.5 |
| Example 18 | $3.5 \times 10^2$ | 2.7 | 1.9 |
| Example 19 | $9.5 \times 10^2$ | 2.4 | 1.7 |
| Example 20 | $1.0 \times 10^4$ | 4.5 | 2.8 |
| Example 21 | $1.5 \times 10^3$ | 1.6 | 1.5 |

As can be seen from Table 2A and 2B, even if the power resistor including the sintered body having the first regions and the second regions with a larger carbon powder content than in the first regions was a high-resistance resistor (each of Examples 11 to 20) whose resistivity exceeded $10^2$ Ω·cm, it was possible to uniformly and stably manufacture the resistor such that the intra-resistor resistance ratio was low, 10 or lower, and the inter-resistor resistance ratio was as low as 5 or lower. In contrast, in the power resistor of Comparative Example 5 which included the sintered body obtained from the single granulated material prepared by uniformly dispersing the carbon powder and which had a resistivity exceeding $10^2$ Ω·cm, the intra-resistor resistance ratio was 57, which was far higher than 10, and the inter-resistor resistance ratio was 28, which also was far higher than 5. This demonstrates that the power resistor of Comparative Example 5 lacks stability.

Also, as indicated by the power resistor of Example 21, the effect of the present invention can be achieved when the first regions have a carbon powder amount by which the resistance is essentially higher than that in the second regions.

Additionally, a surge voltage equivalent to energy of 200 J/cm$^3$ was applied to the power resistors of Examples 11 to 21 repetitively at predetermined intervals to allow the resistors to be cooled, and the resistance, R, of each resistor was measured. Assuming the initial value was $R_0$, the resistance change was calculated from the equation presented earlier. Note that the resistance change is preferably 10% or lower.

As a result, each resistor had a resistance change of 10% or less, indicating a high stability against surge absorption. Also, the sintered bodies of the resistors in Examples 11 to 21 were dense, i.e., had relative densities of 95% or higher. Therefore, each of these resistors was good for a power resistor because of its large heat capacity of nearly 3 J/cm$^3$.

EXAMPLE 22

5 wt. % (solid content) of paraffin as a molding binder were added to an aluminum oxide powder with a mean particle size of 0.2 μm, and the resultant material was formed into a slurry by using xylene as a solvent. The slurry was dried and granulated to prepare a first granulated material.

Separately, a predetermined amount of a methanol solution of polyvinylpyrrolidone as a carbon source was added to an aluminum oxide powder with a mean particle size of 0.2 μm. The resultant material was mixed and milled by using an alumina pot and alumina balls. The obtained powder was then heated in an argon gas atmosphere at 600° C. for two hours to carbonize the polyvinylpyrrolidone. The heated powder was further milled with alumina balls and ethanol for six hours and dried. Thereafter, 5 wt. % (solid content) of paraffin as a molding binder were added to the dried powder. The resultant material was formed into a slurry by using xylene as a solvent. The obtained slurry was dried and granulated to prepare a second granulated material.

Subsequently, 20 wt. % of the second granulated material were added to the first granulated material, and the resultant material was mixed by a V-type mixer, thereby preparing a granulated material mixture. The granulated material mixture was then molded into a cylindrical disk by using a steel mold. The molded product was placed in a box vessel made from 99.5% pure aluminum oxide, and sintered in an argon gas atmosphere at 1500° C. for one hour, thereby manufacturing a sintered body. The resultant sintered body was found to have, in its interior, first regions containing aluminum oxide with a mean particle size of 1.5 μm and second regions containing aluminum oxide with a mean particle size of 0.3 μm. Also, a high-resistance layer consisting of large particles with a mean particle size of 2 μm and having a mean thickness of 200 μm was formed on the outer surface of the sintered body. The high-resistance layer was found to have a resistivity of $10^{12}$ Ω·cm.

Subsequently, a borosilicate glass powder was coated and baked on the outer circumferential surface of the sintered body, forming an insulating layer on the surface. Thereafter, the two circular major surfaces of the resultant sintered body were polished and processed into an annular shape with an outer diameter of 120 mm, an inner diameter of 35 mm, and a thickness of 25 mm. After the two major surfaces of the sintered body were cleaned, aluminum electrodes were formed on these surfaces by flame spray coating, thereby manufacturing a power resistor.

EVALUATIONS OF BREAKERS

A predetermined number of the power resistors in each of Examples 1, 3, 7, 11, 14, 17, 18, 21, and 22 and Comparative Examples 1 and 5 were stacked, as illustrated in FIG. 8, and supported by the insulating support shaft 28, which extended through the centers of these resistors 30 and constructed from a resin, and the elastic member 31. Each resultant structure was placed in a cylindrical vessel to constitute the closing resistor unit 25. Eleven types of the power circuit breakers 41 were assembled by incorporating these closing resistor units 25 as illustrated in FIG. 7 mentioned earlier.

The closing resistor of each of the 11 types of breakers was subjected to out-of-phase closing, and the energy (energy absorb capacity) capable of being injected into the resistor when the temperature rise of the resistor was within 80° C. was measured. Also, the volume shrinkage of each of the breakers incorporating the power resistors of Examples 1, 3, 7, 11, 14, 17, 18, 21, and 22 and Comparative Example 1 with respect to the breaker incorporating the power resistor of Comparative Example 5 was measured. These measurement results are summarized in Table 3 below.

TABLE 3

| Breaker | Type of power resistor | Energy absorb capacity of resistor (J/cm$^3$) | Volume shrinkage of breaker (%) |
|---|---|---|---|
| No. 1 | Comparative Example 5 | 170 | — |
| No. 2 | Comparative Example 1 | 160 | — |
| No. 3 | Example 1 | 270 | 21 |
| No. 4 | Example 3 | 240 | 15 |
| No. 5 | Example 7 | 250 | 17 |
| No. 6 | Example 11 | 270 | 21 |
| No. 7 | Example 14 | 280 | 22 |
| No. 8 | Example 17 | 240 | 15 |
| No. 9 | Example 18 | 280 | 22 |
| No. 10 | Example 21 | 270 | 21 |
| No. 11 | Example 22 | 270 | 21 |

Additionally, to check the stability of the breaking performance, energy equivalent to out-of-phase closing was applied 20 times to the breakers of Nos. 3 to 11 in Table 3, measuring the resistivity change of the closing resistor. As a result, the resistivity change of each breaker was 10% or less, indicating a high enough stability of the breaking performance.

As has been described above, the present invention can provide a power resistor which has a high heat capacity per unit volume and an appropriate and stable electrical resistance, and in which the resistance changes little with time due to surge absorption.

The present invention can also provide a method of manufacturing a power resistor which has a high heat capacity per unit volume and an appropriate and stable electrical resistance, and in which the resistance changes little with time due to surge absorption.

Furthermore, the present invention can provide a power circuit breaker which includes a closing resistor unit having a large breaking capacity and a stable breaking performance, and which thereby accomplishes a small size and a high performance.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A power resistor comprising:

a sintered body containing aluminum oxide and carbon; and a pair of electrodes formed on two opposing surfaces of said sintered body;

wherein said sintered body consists of a plurality of first regions and a plurality of second regions containing carbon in an amount larger than in each of said first regions;

said second regions having a mean grain size of aluminum oxide particles smaller than that of the aluminum oxide particles in said first regions;

said plurality of first regions occupying a greater part by weight of said sintered body, with said plurality of second regions occupying the remaining part by weight of said sintered body; and the carbon present in said second regions electrically connecting said second regions and said pair of electrodes and existing at triple points of aluminum oxide particles in said second regions.

2. A power resistor according to claim 1, wherein said first regions are essentially insulating, and said second regions are conductive.

3. A power resistor according to claim 1, wherein said sintered body contains 0.005 to 3 wt. % of carbon produced by carbonization of an organic compound, said first regions contain less than 0.2 wt. % (including 0 wt. %) of carbon, and said second regions contain 0.2 to 5 wt. % of carbon.

4. A power resistor according to claim 1, wherein said sintered body is formed by sintering a molded product containing an aluminum oxide powder and a carbon powder and contains 0.3 to 5 wt. % of the carbon powder, said first regions contain less than 1.0 wt. % (including 0 wt. %) of the carbon powder, and said second regions contain 1.0 to 10 wt. % of the carbon powder.

5. A power resistor according to claim 4, wherein a mean particle size of the carbon powder is not more than 0.1 μm.

6. A power resistor according to claim 1, wherein the aluminum oxide particles in said second regions have a mean particle size of 0.2 to 0.5 μm, and the aluminum oxide particles in said first regions have a particle size 2 to 8 times as large as the particle size of the aluminum oxide particles in said second regions.

7. A power resistor according to claim 1, wherein said sintered body has a shape of a disk, and said electrodes are formed on two circular surfaces of said sintered body.

8. A power resistor according to claim 1, wherein said sintered body has a shape of an annular plate, and said electrodes are formed on two annular surfaces of said sintered body.

9. A power resistor according to claims 7 or 8, further comprising an insulating layer formed on an outer circumferential surface of said sintered body.

* * * * *